US010336575B2

(12) United States Patent
Salmikuukka et al.

(10) Patent No.: US 10,336,575 B2
(45) Date of Patent: Jul. 2, 2019

(54) GROUP CALL MANAGEMENT

(71) Applicant: KONE Corporation, Helsinki (FI)

(72) Inventors: Jukka Salmikuukka, Espoo (FI); Salla Mannerjoki, Nukari (FI)

(73) Assignee: KONE CORPORATION, Helsinki (FI)

( * ) Notice: Subject to any disclaimer, the term of this patent is extended or adjusted under 35 U.S.C. 154(b) by 299 days.

(21) Appl. No.: 15/229,364

(22) Filed: Aug. 5, 2016

(65) Prior Publication Data

US 2016/0340148 A1 Nov. 24, 2016

Related U.S. Application Data

(63) Continuation of application No. PCT/FI2014/050168, filed on Mar. 7, 2014.

(51) Int. Cl.
*B66B 1/34* (2006.01)
*B66B 1/46* (2006.01)

(52) U.S. Cl.
CPC ..... *B66B 1/468* (2013.01); *B66B 2201/00* (2013.01); *B66B 2201/4615* (2013.01); *B66B 2201/4676* (2013.01); *B66B 2201/4684* (2013.01)

(58) Field of Classification Search
USPC ..... 187/247
See application file for complete search history.

(56) References Cited

U.S. PATENT DOCUMENTS 4,802,557 A 2/1989 Umeda et al.
6,109,396 A 8/2000 Sirag et al.
8,020,672 B2 * 9/2011 Lin ..... B66B 1/34 187/316
8,719,038 B1 * 5/2014 Gazdzinski ..... G06Q 30/0251 704/275
2004/0188185 A1 9/2004 Pieper
2009/0057068 A1 3/2009 Lin et al.
2011/0024239 A1 * 2/2011 Kocher ..... B66B 5/027 187/249
2011/0174580 A1 7/2011 Tokura
2012/0279807 A1 * 11/2012 Finschi ..... B66B 1/2458 187/384

(Continued)

FOREIGN PATENT DOCUMENTS

CN 101356108 A 1/2009
CN 102482048 A 5/2012

(Continued)

OTHER PUBLICATIONS

Extended European Search Report for European Application No. 14884711.4, dated Sep. 5, 2017.

*Primary Examiner* — Christopher Uhlir
(74) *Attorney, Agent, or Firm* — Birch, Stewart, Kolasch & Birch, LLP

(57) ABSTRACT

In elevator journey prioritization often calls for larger groups are prioritized. This is often misused by placing elevator calls for larger groups that are actually travelling. This problem can be reduced by identifying the calling person when placing the call and again in the elevator. The number of people in the elevator can be estimated by using machine vision or weight-based approximation methods. When the number of passengers is not known the possible misuse can be suspected if a person places considerably more group calls as than average.

9 Claims, 2 Drawing Sheets

(56) References Cited

U.S. PATENT DOCUMENTS

| | | | | |
|---|---|---|---|---|
| 2013/0242074 | A1* | 9/2013 | Sekiguchi | G08B 7/066<br>348/77 |
| 2016/0311646 | A1* | 10/2016 | Bryant | G06K 9/00288 |

FOREIGN PATENT DOCUMENTS

| | | | |
|---|---|---|---|
| JP | 2005-306584 | A | 11/2005 |
| JP | 2008-50066 | A | 3/2008 |
| WO | 2011/141627 | A1 | 3/2008 |
| WO | WO 2013/033879 | A1 | 3/2013 |
| WO | WO 2013/076361 | A1 | 5/2013 |

* cited by examiner

GROUP CALL MANAGEMENT

CROSS REFERENCE TO RELATED APPLICATIONS

This application is a Continuation of PCT International Application No. PCT/FI2014/050168 filed on Mar. 7, 2014, which is hereby expressly incorporated by reference into the present application.

FIELD OF THE INVENTION

The invention relates to controlling group calls in elevator systems.

BACKGROUND OF THE INVENTION

The most traditional method for calling an elevator is to press a button indicating the direction the passenger is wishing to travel. This is, however, insufficient with the modern elevator systems of today when elevator groups may have a large number of elevators with different properties. For example, in the group there may be express elevators with preselected possible destinations. Such systems typically exist in large buildings with a need for a high capacity elevator system.

The efficiency of the elevator system may be improved by using so called destination control system with possibility to indicate a number of the persons travelling with the person who made an elevator call. An elevator call for a plurality of people is known as a group call. The similar functionality may be done, for example, by requesting each traveler to indicate the destination by themselves. When a plurality of people belonging to the same group presses the button, or a person calling the journey for the complete group indicates the number of travelers, the group controller may allocate the journey efficiently. For example, when there is a group of 16 people and the capacity of the elevator is 16 people, the elevator knows that in order to fit the group to one elevator it must bring an empty elevator. Furthermore, the group controller knows that then the elevator is full and it should not do intermediate stops before the group has reached the desired destination.

The functionality discussed above may be implemented with prioritization algorithms. For example, an elevator call for ten people may be prioritized over an elevator call just for one or longer journeys may be prioritized over short ones.

The problem with the prioritization mentioned above is that persons tend to order journeys for larger groups, for example, because of the prioritization or just for the sake of the convenience of travelling alone or in smaller groups. The same applies to journey lengths, wherein a person may make two elevator calls. The first call is the call for the real journey and the second call is imaginary call, for example, for more people and farther from the calling floor.

Even if the prioritization is not used in all elevator systems they share the same problem as people tend to use same behavior when they do not know for sure if there is prioritization or not. Thus, persons tend to make calls for larger groups or imaginary calls in order to support their own calls. This reduces the capacity of the elevator system as the elevators travel with non-optimal load.

In order to reduce false calls a system with a light port has been used. If an elevator has been called from a floor and nobody steps in the call can be cancelled. The problem with this system is that it only notices the difference between zero and at least one passenger. Thus, it cannot be used for larger groups or imaginary calls. Furthermore, the mechanism does not work if there are more people travelling from the same floor and one person places an imaginary call as others will enter the elevator anyway. Thus, the light port will indicate that at least one person has entered the elevator.

Thus, there is a need for an elevator system facilitating the removal of falsified and imaginary calls. Correspondingly, there is a need for facilitating the removal of accidentally placed incorrect calls.

SUMMARY

In elevator journey prioritization often calls for larger groups are prioritized. This is often misused by placing elevator calls for larger groups that are actually travelling. This problem can be reduced by identifying the calling person when placing the call and again in the elevator. The number of people in the elevator can be estimated by using machine vision or weight-based approximation methods. When the number of passengers is not known the possible misuse can be suspected if a person places considerably more group calls as than average.

The present invention discloses an arrangement for controlling group calls efficiently. In an embodiment of the invention a method for controlling groups calls in an elevator system is disclosed. In the method an identification of a person calling an elevator from an elevator calling panel is first received. Then, a call for an elevator for a group of people, wherein the number of passengers is included in the call information is received. These two steps can be done also in different order, where the call is first placed and then confirmed with the identification. Next an identification identifying the same person from called elevator car is received. The received information is then stored to a memory of an apparatus connected to said elevator system and processed by using a processor of the apparatus.

In a further embodiment the method further comprises receiving an image comprising passengers in the called elevator car. If the received image is used as the identification received from the called elevator car, the calling person is recognized from the image. In a further embodiment further comprises counting the number of passengers from said received image. In an alternative embodiment the the weight of the elevator car is received from a weighing device coupled to the elevator car and the number of people in the elevator car is estimated based on the known elevator car weight and predetermined average weight of a person. In a further embodiment the counted or estimated number of passengers is compared to the number of passengers according to placed elevator calls. In a further embodiment a predetermined action is performed when the result of the comparison shows difference in the compared numbers. The further action can be requesting an identification of the calling person when the identification from the called elevator car is not received. In another embodiment the call is cancelled if the identification is not received.

In an embodiment of the invention the method disclosed above is implemented as a computer program comprising computer program code causing a computing device to perform the method when the computer program is executed.

In an embodiment of the invention an apparatus comprising at least one memory and at least one processor, wherein the apparatus is configured to communicate with an elevator calling panel and an elevator control panel, wherein the at least one memory and the computer program code mentioned above are working together, with the at least one processor, cause the apparatus to perform a method disclosed above.

In an embodiment of the invention the apparatus is included in an elevator system comprising an elevator car coupled to a hoisting machine by a hoisting rope, an elevator calling panel and an elevator control panel. In an embodiment of the invention the elevator system further comprises a camera configured to take images from said elevator car or a weighing device configured to weigh the elevator car.

The benefits of the embodiments mentioned above include the possibility to reduce the misuse of group calling function by monitoring persons using group calls. In more advanced embodiments, as disclosed above, the monitoring may be automatic and done in real time. In these cases the algorithm controlling movements of elevators in an elevator group may make changes to already placed calls when it notices that the occupancy in the elevator does not match with the scheduled occupancy.

The actions discussed above are effective also in the cases when the incorrect information is not given on purpose. For example, a group call may have been placed and the group accidentally enters to an elevator that was not assigned to that group or for some reason the group decides not to enter to the elevator at all.

In both cases mentioned above, the purposive misuse and unintentional incorrect group calls, the present invention improves the efficiency of the elevator group by allocating the passengers more effectively to elevator cars. For the owner of the elevator system this provides a plurality of benefits. For example, time is not wasted as rides are faster. Furthermore, electricity is saved when the elevator cars can be filled effectively and unnecessary rides with inefficiently filled elevator cars can be avoided. Furthermore, when the efficiency of the elevator system is improved with better allocation smaller and fewer elevator cars are needed for the same quality of the service. Thus, the owner may choose from saving money and maintaining the quality of service or having better service with the same cost.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, examples of which are illustrated in the accompanying drawings.

Figure 1:
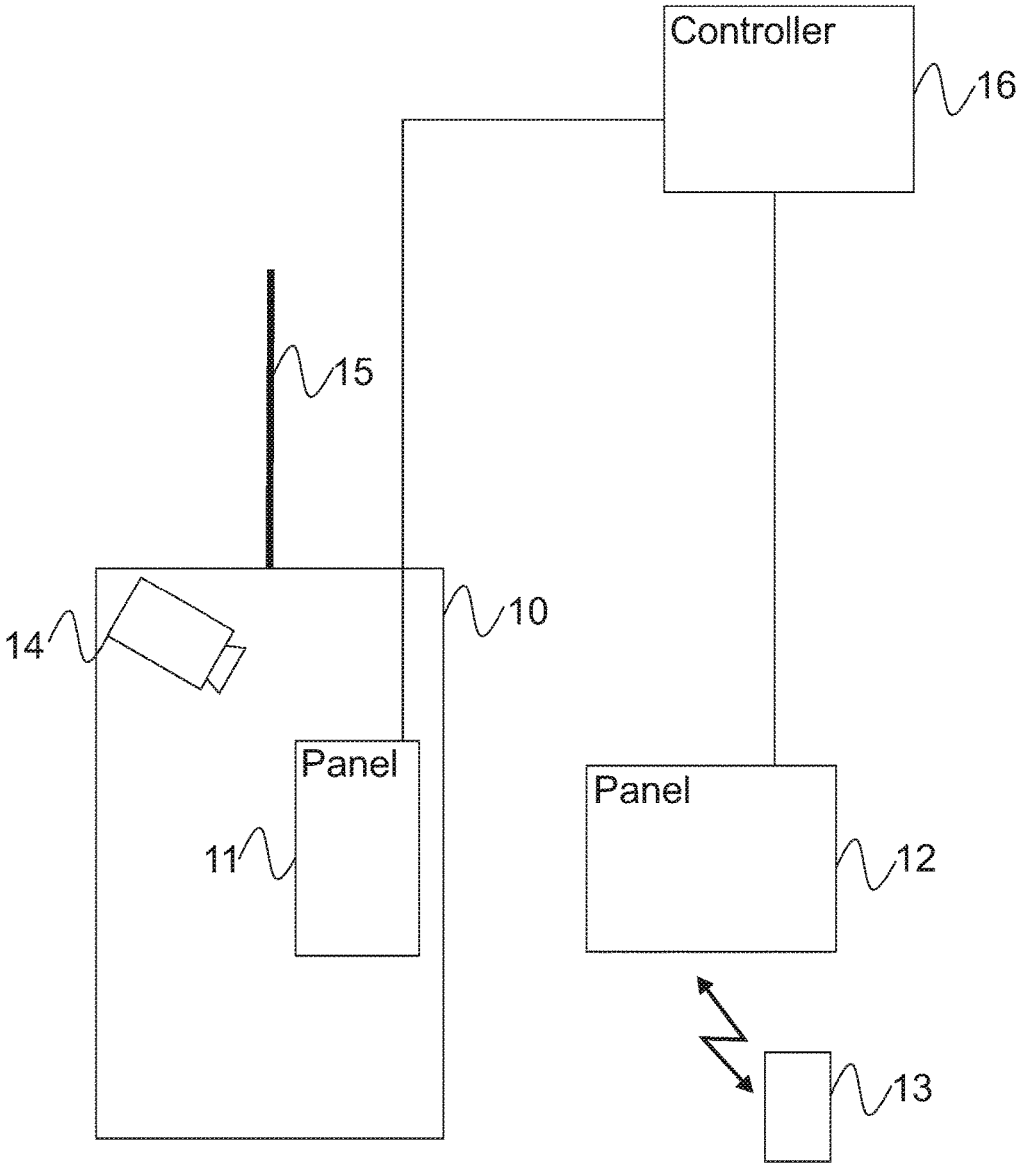
FIG. 1 is a block diagram of an example embodiment of the present invention.

In FIG. 1 an embodiment of the present invention is disclosed. In the embodiment an elevator car 10 is called by using calling panel 12. The calling panel 12 is typically a panel operating together with a destination control system. The panel is connected to the controller 16, which in this embodiment controls all the movements of the elevator car 10, however, it is possible that the destination control system is separate device to the controller controlling movements of the elevator car 10. In FIG. 1 only one elevator car 10 is illustrated, however, modern elevator systems typically include a plurality of elevators that are controlled by the same destination control system. Thus, it may allocate efficiently journeys called by passengers.

In the embodiment of FIG. 1 the person calling an elevator uses a keycard 13 for providing personal identification to the system. After identification the person uses the calling panel 12 for calling an elevator to a group of persons. This is performed by entering the destination floor and the number of passengers.

When the elevator car 10 arrives at the calling floor the group enters to the elevator car 10. After entering the calling person is identified again, for example, by introducing the keycard 13 to the control panel 11 of the elevator car 10. After identification the journey typically begins. The processing associated with the second identification is explained in more detail together with referral to FIG. 2.

In another embodiment instead of keycard 13 a mobile phone is used as an identification device. In such case it is possible to use any suitable local communication means for identification. Examples of such communication means are near field communication, Bluetooth, and wireless local area network. Thus, it is not necessary to introduce the device to the receivers located together with panels 11 and 13 but the device can be recognized from the pocket of the caller. When more than one mobile device is in the vicinity a confirmation or other method for securing the identity of a person may be used.

In embodiment of FIG. 1 a camera 14 is used to take images from the elevator. From the images the number of passengers can be counted. In a further embodiment a machine vision based identification method may be used. For example, person identified at the calling panel has a profile in the system. The profile includes at least one image of the profile holder. Based on these images the person can be recognized in the elevator.

The elevator car 11 is connected to the hoisting machine with rope 15. In another embodiment the number of passengers is estimated from the weight of the elevator car 10. The weight is measured with the weighing device of the hoisting arrangement and it can be implemented in various ways and is a common component in most of the elevator systems even if it is not always necessary.

Figure 2:
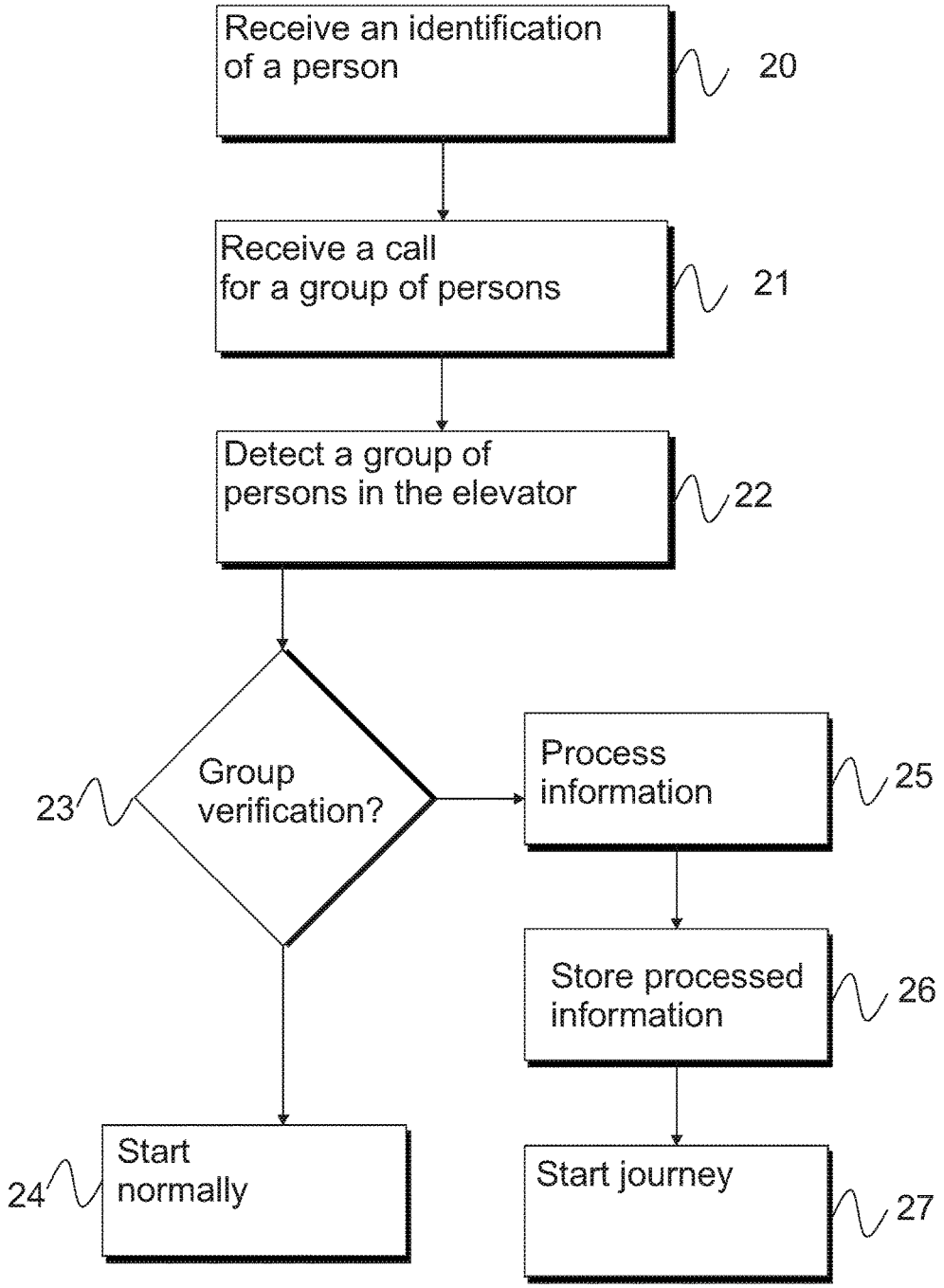
FIG. 2 is a flow chart of an embodiment of the present invention.

In FIG. 2 a flow chart is disclosed. In the embodiment a group of people is in need of elevator journey. The journey begins by identifying one person at the calling panel, step 20. The identification may be done by using suitable communication means, such as an RFID-based keycard, near field communication implemented in a mobile device such as mobile phone, personal identification code, or similar. The call panel is typically coupled to a destination control system. After the identification the identified person makes the call, step 21. The call information includes the destination floor and number of passenger. Based on this information the destination control system allocates a journey and instructs the caller and the group to the allocated elevator. As the call information includes the identification of the calling person plurality of calls made by the same person can be prevented. For example, if the same person wishes to make second call the calling panel may request if the person wishes to cancel the previous call and place a new or to maintain the previous call.

The journey begins when the elevator arrives at the calling floor and the group enters to the elevator. As the number of persons is known the system needs to count or estimate the number of persons entered to the elevator and compare the counted or estimated number of persons to the call information, step 22. This can be done by several ways. For example, each elevator typically comprises a weighing device. The number of persons can be estimated by dividing the measured weight by average person weight, which is often 80 kg but may be adjusted, for example, according to the geographical area. Instead of weighing device a machine vision detection system may be used. In such system an image is taken when the beginning of the journey, for example, when the doors are closed but the elevator does not move yet. Then, from the image the number of persons may be count. Based on the call information the elevator system always knows how many people should be in the elevator. This number can be verified and corrected when the machine vision counting gives different result than the accumulated call information.

The procedure described above may include the detection of calling person. This may be done, for example, by introducing the same means as when calling the elevator. In a further embodiment the person is detected from the machine vision image described above. For machine vision matching the system needs an image of the person who called the elevator. The image may be taken by digital camera arranged to the calling panel or it may be stored in to the profile of the person. The profile may include other relevant information for placing call, such as access rights.

When the number of people who have entered and the identities of persons having made the calls are known the gathered information may be compared with the call information, step 23. If the information matches the elevator ride starts normally, step 24. When starting normally the information may be stored statistics system. When the information does not match the result is processed, step 25.

The processing may include various actions. For example, if the person who made the call cannot be identified in the elevator car the elevator system may show on a screen a message asking the identification. If the identification is not made within a time limit the call is cancelled. The purpose of this is to reduce unauthorized access to possibly locked floors. When the number of persons in the elevator does not match with the call information may be used to detect people misusing the system. For example, if the elevator car is staring from a floor and only one person has been identified with a call to ten people and only one person enters to the elevator the system immediately detects possible misuse of the system. The system may be configured such that after certain number of possible misuses the possibility to place group calls is reduced or the person placing possible misuses is investigated or interviewed. When two or more people have identified themselves but the number of persons in the elevator is considerably less than it should be all identified persons may be added to the statistics but not counted as possible misuse as described above as it is very difficult to detect who placed the possible misuse call. Instead these persons may be placed into separate second statistics. If a person continuously misuses call system by placing group calls the misuse may be detected even if the person is in the second statistics only as the person who is misusing will be placed to the second statistics on every journey and others are random travelers and typically will be stored considerably less frequently in the statistics.

Furthermore, these two statistics may be combined by using different methods. For example, a hit in the first statistics may give ten points and in the second statistics only 1 point. Then the system may be configured to perform an action, such as reducing the possibility to place group calls after 50 points.

In a simpler embodiment the statistics include only the number of group calls a person has placed without using the number of passengers. In this embodiment the misuse may be suspected from the fact a person places considerably more group calls than average person.

After processing the information the elevator system acts in accordance with the processing result, which typically means the start of the journey. Even if the misuse has been detected the normal operation is often desired as it is not intention to disturb other people who are not misusing the system by causing unnecessary delays, step 27. However, even if in the embodiment of FIG. 2 the journey is started after processing the information it is not the only option but, for example, the journey may also prevented.

In an embodiment the controller 16 of FIG. 1 comprises at least one processor and at least one memory, wherein the memory includes computer program code for one or more programs, the at least one memory and the computer program code are working together, with the at least one processor, cause the apparatus to perform a method disclosed above with referral to FIG. 2.

The above mentioned method may be implemented as computer software which is executed in a computing device able to communicate with a mobile device. When the software is executed in a computing device it is configured to perform the above described inventive method. The software is embodied on a computer readable medium so that it can be provided to the computing device.

As stated above, the components of the exemplary embodiments can include computer readable medium or memories for holding instructions programmed according to the teachings of the present inventions and for holding data structures, tables, records, and/or other data described herein. Computer readable medium can include any suitable medium that participates in providing instructions to a processor for execution. Common forms of computer-readable media can include, for example, a floppy disk, a flexible disk, hard disk, magnetic tape, any other suitable magnetic medium, a CD-ROM, CD±R, CD±RW, DVD, DVD-RAM, DVD±RW, DVD±R, HD DVD, HD DVD-R, HD DVD-RW, HD DVD-RAM, Blu-ray Disc, any other suitable optical medium, a RAM, a PROM, an EPROM, a FLASH-EPROM, any other suitable memory chip or cartridge, a carrier wave or any other suitable medium from which a computer can read.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A method for controlling groups calls in an elevator system, the method comprising the steps of:

receiving a first identification of a user from an elevator calling panel, then;

receiving a call from the elevator calling panel from the user, the call indicating that a group of people will be entering an elevator and a number of passengers will be in the group, then;

after the user and the group enters a called elevator car, requesting a second identification of the user via the elevator system, and performing a second identification of the user via an RFID-based keycard or near field communication implemented on a mobile phone of the user;

determining the number of passengers in the group entering into the elevator using a weighing device or machine vision;

if the determined number of passengers matches the indicated number of passengers, then starting an elevator ride of the called elevator car; and if the determined number of passengers does not match the indicated number of passengers, preventing the starting of the elevator ride of the called elevator car.

2. The method according to claim 1, wherein said method further comprises receiving an image comprising the passengers in said called elevator car.

3. The method according to claims 2, wherein the said received image is used to recognize the user from said image.

4. The method according to claim 1, wherein the method further comprises receiving a weight of said elevator car from the weighing device coupled to said elevator car and estimating a number of people in said elevator car based on the known elevator car weight and a predetermined average weight of a person.

5. A computer program embodied on a non-transitory computer readable medium and comprising code adapted to perform the method according to claim 1 when executed on a computing system.

6. An apparatus comprising at least one memory and at least one processor, wherein said apparatus is configured to communicate with an elevator calling panel and an elevator control panel, and wherein said at least one memory and a computer program code work together, with the at least one processor, to cause the apparatus to perform the method according to claim 1.

7. An elevator system comprising:

an elevator car coupled to a hoisting machine by a hoisting rope;

an elevator calling panel;

an elevator control panel; and the apparatus according to claim 6.

8. The system according to claim 7, wherein the machine vision includes a camera configured to take images from said called elevator car.

9. The system according to claims 7, wherein the weighing device is configured to weigh said called elevator car.

* * * * *